US009802680B2

(12) United States Patent
Biggica, Sr.

(10) Patent No.: US 9,802,680 B2
(45) Date of Patent: Oct. 31, 2017

(54) FISHING SEAT APPARATUS

(71) Applicant: Jack Biggica, Sr., Ronkonkoma, NY (US)

(72) Inventor: Jack Biggica, Sr., Ronkonkoma, NY (US)

( * ) Notice: Subject to any disclaimer, the term of this patent is extended or adjusted under 35 U.S.C. 154(b) by 0 days.

(21) Appl. No.: 15/374,843

(22) Filed: Dec. 9, 2016

(65) Prior Publication Data

US 2017/0190389 A1 Jul. 6, 2017

Related U.S. Application Data

(60) Provisional application No. 62/266,198, filed on Dec. 11, 2015.

(51) Int. Cl.
*B63B 29/06* (2006.01)
*B63B 29/04* (2006.01)

(52) U.S. Cl.
CPC ..... *B63B 29/04* (2013.01); *B63B 29/06* (2013.01); *B63B 2029/043* (2013.01); *B63B 2709/00* (2013.01)

(58) Field of Classification Search
CPC ..... B63B 29/04
See application file for complete search history.

(56) References Cited

U.S. PATENT DOCUMENTS 4,682,438 A * 7/1987 Arrow ..... A01K 97/10 108/48
4,766,838 A * 8/1988 Johnson ..... B63B 29/04 114/363
5,168,825 A * 12/1992 Ring ..... B63B 29/04 114/363
6,729,685 B1 * 5/2004 Ebalobor ..... A47C 9/06 108/13
7,146,927 B1 * 12/2006 Wright ..... A01K 97/06 114/347

* cited by examiner

*Primary Examiner* — Edwin Swinehart
(74) *Attorney, Agent, or Firm* — Ruth Eure

(57) ABSTRACT

A fishing seat apparatus for use with a boat's gunwale or rail to function as a support station and place to sit for an angler fully involved in fishing action is provided. The fishing seat apparatus comprises a main frame and a seat member positioned on the main frame. A support leg is secured to the main frame and extends in a generally downward direction. A first hook member extends from the main frame and a second hook member extends from the main frame. A tray spans between and is mounted on top of the first hook member and the second hook member. The first hook member and the second hook member allow the user to releasably secure the fishing seat apparatus to the boats gunwale or rail for use during fishing activities.

20 Claims, 1 Drawing Sheet

FISHING SEAT APPARATUS

CLAIM OF PRIORITY

This patent application claims priority under 35 USC 119 (e) (1) from U.S. Provisional Patent Application Ser. No. 62/266,198 filed Dec. 21, 2015, of common inventorship herewith entitled, "Fisherman's Seat", which is incorporated herein by reference as though the same were set forth its entirety.

FIELD OF THE INVENTION

The present invention pertains to the field of fishing industry, and more specifically to the field of portable fishing seats.

BACKGROUND OF THE INVENTION

For outdoor enthusiasts, there are few ways to pass a day that compare to a day spent fishing. Whether fishing from a boat or pier, riverbank or lakeshore, fisherman go fishing for the prospect of catching supper and also for the experience. The sport of fishing involves casting lures or bait into dark waters where, hopefully, a fish will grab the hook and then fight to stay in its watery realm while the angler battles to take the fish out of the water. Some anglers enjoy the physical activity of fly fishing or surf fishing, two forms of fishing that require the angler to stand in the water and use a considerable element of athleticism to land the fish. Some anglers prefer the quiet contemplation afforded by slow and steady pier fishing, where one casts out a baited rig and then waits, sometimes for long periods while imbibing a cold beverage. Still other anglers enjoy trolling from boats. In each angling scenario, fishing places individuals into a natural world of considering things from a fish's point of view. A day's fishing forces us to slow down, leave the frantic pace of human society behind for a while, drop cares and petty problems and focus on a seemingly simpler matter of catching a fish. A day's fishing forces one's mind to flow like a river, smoothly between banks.

Fishing presents certain challenges beyond the obvious challenge of catching fish. Knots sometimes refuse to hold in monofilament line. Fingers get impaled on hooks meant for fish. Lines snarl and tangle. A drawback of fishing, whether from a boat, dock or pier, is having to stand for long periods of time in order to fish.

The prior art has put forth several designs for portable fishing seats. Among these are:

US Pat. No. 8,251,455 to Thomas Midkiff, John R. Tolbert, Sr. and John R. Tolbert II describes a fishing chair mountable on a pier railing or truck tailgate and including a frame for supporting a chair seat. A first arm member extends from the frame to a point above the seat. A pair of finger members extends from the first arm member for engaging over and around a pier railing or truck tailgate. A second arm member extends from the frame for resting against a face of a wall of the pier or tailgate for allowing the chair to cantilever out from the pier wall or tailgate without making contact with the ground below. A leg extends downward from the frame and has a pair of wheels so the fishing chair is rollable onto and away from the mounting position. A rod holder is mounted on the first arm member. The seat is positioned to have a user face the pier railing when the chair is mounted thereupon, and the seat is positioned to have a user face away from the truck tailgate when the chair is mounted thereupon.

U.S. Pat. No. 2,725,925 to Jerry R. Sanderson and Walter H. Sanderson describes a comfortable folding seat that is readily carried and applied to certain stationary structures or supports such as windows in homes, apartments and office buildings as well as ball parks, circuses and like places where planks or boards are used for seating purposes. The folding seat has a base with side members terminating at their forward extremities in downturned, rearwardly disposed hooks. A lip connects said hooks at their terminals. A resilient tongue extends rearwardly from said lip cooperating with said lip and said base to receive and releasably grip a support. A back is hinged to said base, and arms are pivotally secured to said back and offset therefrom and from said base. Fingers carried by said arms extend laterally therefrom and are received freely upon said base to support said arms in one position of said back.

U.S. Pat. No. 2,333,734 to Richard G. Nieltopp describes a collapsible seat primarily configured for use while fishing from a boat, pier or the like. Protected by guardrails, the seat is firmly associated with the rails when in a set up position, preventing any possibility of casual removal or displacement. The seat member is a flat elongated and substantially rectangular formation to provide a relatively wide short portion and a relatively narrow long portion. The long portion receives a user in a straddling position. The sides and ends of the long portion are rounded to eliminate sharp edges for the sake of comfort while the sides of the short portion are flat. Bearing clamps are bolted to the short portion adjacent to its outer end and sides thereof as well as on its upper surface A rod extending transversely of the short portion is comprised of a length for disposal beyond the sides thereof to accommodate rocking movement of a boat or pier.

None of these prior art references describe the present invention.

SUMMARY OF THE INVENTION

It is an object of the present invention to provide a portable folding chair engineered specifically for use with a boat's gunwale or rail to function as a support station and place to sit for an angler fully involved in fishing action.

The present invention is a fishing seat apparatus for use with a boat's gunwale or rail to function as a support station and place to sit for an angler fully involved in fishing action. The fishing seat apparatus comprises a main frame and a seat member positioned on the main frame. A support leg is secured to the main frame and extends in a generally downward direction. A first hook member extends from the main frame and a second hook member extends from the main frame. A tray spans between and is mounted on top of the first hook member and the second hook member. The first hook member and the second hook member allow the user to releasably secure the fishing seat apparatus to the boat's gunwale or rail for use during fishing activities.

In addition, the present invention includes a fishing seat apparatus for use with a boat's gunwale or rail to function as a support station and place to sit for an angler fully involved in fishing action. The fishing seat apparatus comprises a main frame having a front frame member, a first frame member, and a second frame member with the first frame member being substantially perpendicular to the front frame member and the second frame member being substantially perpendicular to the front frame member. A seat member is positioned on the main frame with an adjustable support leg secured to the main frame and extending in a generally downward direction. An adjustable first hook member extends from the main frame and an adjustable second hook member extending from the main frame. A tray spans between and is mounted on top of the first hook member and the second hook member. The first hook member and the second hook member allow the user to releasably secure the fishing seat apparatus to the boat's gunwale or rail for use during fishing activities.

The present invention further includes a method for constructing a fishing seat apparatus for use with a boats gunwale or rail to function as a support station and place to sit for an angler fully involved in fishing action. The method comprises providing a main frame, positioning a seat member on the main frame, securing a support leg to the main frame, extending the support leg in a generally downward direction, extending a first hook member from the main frame, extending a second hook member from the main frame. spanning a tray between the first hook member and the second hook member, mounting the tray on top of the first hook member and the second hook member, and releasably securing the fishing seat apparatus to the boat's gunwale or rail for use during fishing activities.

DETAILED DESCRIPTION OF THE INVENTION

Figure 1:
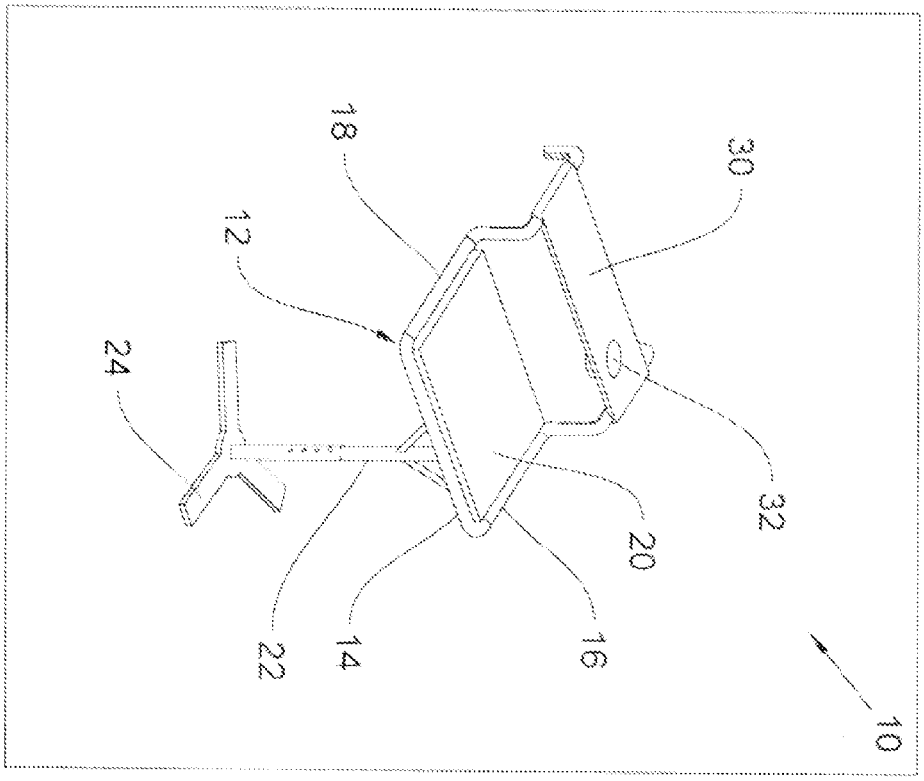
FIG. 1 is a front perspective view illustrating a fishing seat apparatus, constructed in accordance with the present invention.
Figure 2:
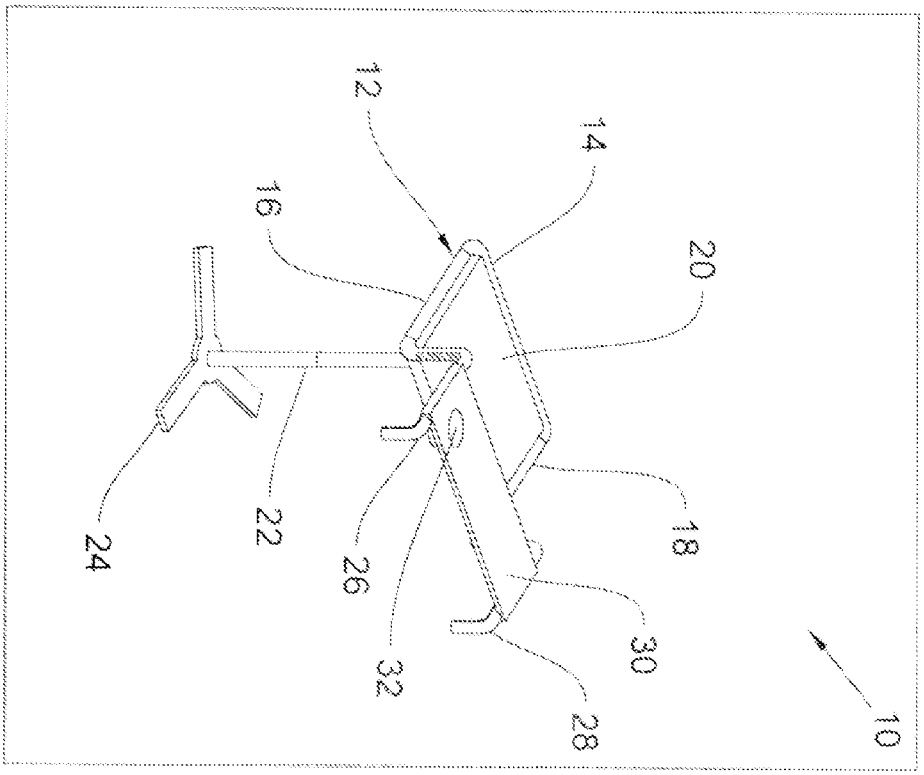
FIG. 2 is a rear perspective view illustrating the fishing seat apparatus, constructed in accordance with the present invention.

The present invention, hereinafter referred to as a Fishing Seat Apparatus, indicated generally at 10, is a portable folding chair engineered specifically for use with a boat's gunwale or rail to function as a support station and place to sit for an angler fully involved in fishing action. Stable and adjustable, the Fishing Seat Apparatus 10 is a portable folding seat that is particularly engineered for use on boats, but is efficiently adaptable for use on docks and piers with railings.

The Fishing Seat Apparatus 10 of the present invention includes a U-shaped main frame 12 having a front frame member 14, a first frame member 16, and a second frame member 18. The front frame member 14 has a first end and a second end, the first frame member 16 has a first end and a second end, and the second frame member 18 has a first end and a second end. The first end of the front frame member 14 is connected to the first end of the first frame member 16. The second end of the front frame member 14 is connected to the first end of the second frame member 18. Preferably, the first frame member 16 is substantially perpendicular to the front frame member 14 and the second frame member 18 is substantially perpendicular to the front frame member 14.

Positioned on a top surface of the front frame member 14, the first frame member 16, and the second frame member 18 of the Fishing Seat Apparatus 10 of the present invention is a seat member 20. Preferably, the seat member 20 is a memory foam or similar cushioned, waterproof seat providing optimal comfort to the user.

The Fishing Seat Apparatus 10 of the present invention additionally includes a support leg 22 secured to the main frame 12 and extending in a generally downward direction. The support leg 22 is preferably an adjustable pole or leg with an integrated pin and hole telescoping functionality. Measuring approximately eighteen (18") inches to approximately thirty (30") inches in height, the support leg 22 vertically culminates in three integrated support feet 24 which rest on the deck, one short foot flanked by two long feet 24. Preferably, the feet 24 are padded with rubber or other resilient material to better grip the boat deck and to inhibit damage to the boat deck.

In addition, the Fishing Seat Apparatus 10 of the present invention includes a U-shaped first hook member 26 having a first end and a second end and a U-shaped second hook member 28 having a first end and a second end. The first end of the first hook member 26 is connected to the second end of the first frame member 16 and the first end of the second hook member 28 is connected to the second end of the second frame member 18. Measuring approximately seven (7") inches to thirteen (13") inches in attachable length, the first hook member 26 and the second hook member 28 act as supports for the front of the Fishing Seat Apparatus 10. The first hook member 26 and the second hook member 28 can be mounted to the center-front of the seat member 20 and the sitting fisherman would straddle them.

The first hook member 26 and the second hook member 28 allow the user to releasably secure the Fishing Seat Apparatus 10 of the present invention to the boat rail or gunwale for use during fishing activities. The underside of the first hook member 2 and the second hook member 28 are preferably padded with rubber or other resilient material to ensure a stable grip and support, and prevent any marring of the boat's finish.

In a preferred embodiment, the first hook member 26 and the second hook member 28 of the Fishing Seat Apparatus 10 of the present invention are extendable and retractable to better conform to the exact size of the boat rail or gunwale. In this manner the first hook member 26 has a first portion and a second portion with the second portion slidably receivable within the first portion and the second hook member 28 has a first portion and a second portion with the second portion slidably receivable within the first portion. The relative positioning of the first portions to the second portions of the first hook member 26 and the second hook member 28 can be releasably maintained via friction or other mechanical securing means.

Furthermore, the Fishing Seat Apparatus 10 of the present invention includes a tray 30 spanning between and mounted on top of the first hook member 26 and the second hook member 28. Preferably, the tray 30 includes a cup holder 32 formed therein sized and shaped for receiving a variety sizes of cups, glasses, bottles, cans, etc. The tray 30 also functions as convenient amenity for keeping tackle and other items close at hand as well as a beverage.

Preferably, the Fishing Seat Apparatus 10 of the present invention is fabricated in aluminum square stock or round tubing. The Fishing Seat Apparatus is structurally configured to attach simultaneously to a boat rail and its deck as opposed to being a standalone structure.

The Fishing Seat Apparatus 10 of the present invention provides an angle with a simple, compact, comfortable and easily portable seat to ease the strain of standing for long periods while fishing. The Fishing Seat Apparatus 10 is easy to carry and stow and also easy to set up and use. Durably constructed from high quality materials, the Fishing Seat Apparatus 10 will withstand many years of continued use.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claims.

The invention claimed is:

1. A fishing seat apparatus for use with a boat's gunwale or rail to function as a support station and place to sit for an angler fully involved in fishing action, the fishing seat apparatus comprising:

a main frame;

a seat member positioned on the main frame;

a support leg secured to the main frame and extending in a generally downward direction;

a first hook member extending from the main frame;

a second hook member extending from the main frame; and a tray spanning between and mounted on top of the first hook member and the second hook member;

wherein the first hook member and the second hook member allow the user to releasably secure the fishing seat apparatus to the boat's gunwale or rail for use during fishing activities.

2. The fishing seat apparatus of claim 1 wherein the main frame has front frame member, a first frame member, and a second frame member, wherein the front frame member has a first end and a second end, the first frame member has a first end and a second end, and the second frame member has a first end and a second end, wherein the first end of the front frame member is connected to the first end of the first frame member and the second end of the front frame member is connected to the first end of the second frame member.

3. The fishing seat apparatus of claim 2 wherein the first frame member is substantially perpendicular to the front frame member and the second frame member is substantially perpendicular to the front frame member.

4. The fishing seat apparatus of claim 1 wherein the seat member is a memory foam cushioned., waterproof seat.

5. The fishing seat apparatus of claim 1 wherein the seat member is framed by the main frame and free from extension beyond the main frame.

6. The fishing seat apparatus of claim 1 wherein the support leg is an adjustable pole or leg with an integrated pin and hole telescoping functionality.

7. The fishing seat apparatus of claim 1 wherein the support leg vertically culminates in three integrated support feet.

8. The fishing seat apparatus of claim 7 wherein the feet are padded with rubber or other resilient material.

9. The fishing seat apparatus of claim 1 wherein the first hook member and the second hook members each have an adjustable length such that the first hook member and the second hook member are independently extendable and retractable.

10. The fishing seat apparatus of claim 9 wherein the length of the first hook member and the second hook member are releasably securable in a desired length.

11. The fishing seat apparatus of claim 1 wherein an underside of the first hook member and the second hook member are padded with rubber or other resilient material.

12. The fishing seat apparatus of claim, wherein the tray has a cup holder formed therein.

13. A fishing seat apparatus for use with a boat's gunwale or rail to function as a support station and place to sit for an angler fully involved in fishing action, the fishing seat apparatus comprising:

a main frame having a front frame member, a first frame member: and a second frame member, the first frame member being substantially perpendicular to the front frame member and the second frame member being substantially perpendicular to the front frame member;

a seat member positioned on the main frame;

an adjustable support leg secured to the main frame and extending in a generally downward direct on;

an adjustable first hook member extending from the main frame;

an adjustable second hook member extending from the main frame; and a tray spanning between and mounted on top of the first hook member and the second hook member;

wherein the first hook member and the second hook member allow the user to releasably secure the fishing seat apparatus to the boat's gunwale or rail for use during fishing activities.

14. The fishing seat apparatus of claim 13 wherein the main frame, wherein the front frame member has a first end and a second end, the first frame member has a first end and a second end, and the second frame member has a first end and a second end, wherein the first of the front frame member is connected to the first end of the first frame member and the second end of the front frame member is connected to the first end of the second frame member.

15. The fishing seat apparatus of claim 13 wherein the seat member is a memory foam cushioned, waterproof seat.

16. The fishing seat apparatus of claim 13 wherein the support leg has an integrated pin and hole telescoping functionality.

17. The fishing seat apparatus of claim 13 wherein the support leg vertically culminates in three integrated support feet, the feet being padded with rubber or other resilient material.

18. The fishing seat apparatus of claim 13 wherein the length of the first hook member and the second hook member are releasably securable in a desired length.

19. The fishing seat apparatus of claim 13 wherein an underside of the first hook member and the second hook member are padded with rubber or other resilient material.

20. A method for constructing a fishing seat apparatus for use with a boat's gunwale or rail to function as a support station and place to sit for an angler fully involved in fishing action, the method comprising:

providing a main frame;

positioning a seat member on the main frame;

securing a support leg to the main frame;

extending the support leg in a generally downward direction;

extending a first hook member from the main frame:

extending a second hook member from the main frame;

spanning a tray between the first hook member and the second hook member;

mounting the tray on top of the first hook member and the second hook membered, and releasably securing the fishing seat apparatus to the boat's gunwale or rail for use during fishing activities.

* * * * *